US009627817B2

(12) United States Patent
Chang

(10) Patent No.: US 9,627,817 B2
(45) Date of Patent: Apr. 18, 2017

(54) ELECTRICAL CONNECTOR HAVING A GOOD HIGH FREQUENCY TRANSMISSION PERFORMANCE

(71) Applicant: LOTES CO., LTD, Keelung (TW)

(72) Inventor: Wen Chang Chang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/156,704

(22) Filed: May 17, 2016

(65) Prior Publication Data

US 2017/0077651 A1 Mar. 16, 2017

(30) Foreign Application Priority Data

Sep. 16, 2015 (CN) ..... 2015 2 0712715 U

(51) Int. Cl.

| | |
|---|---|
| ***H01R 13/648*** | (2006.01) |
| ***H01R 13/6581*** | (2011.01) |
| ***H01R 13/6597*** | (2011.01) |
| ***H01R 24/64*** | (2011.01) |
| *H01R 107/00* | (2006.01) |

(52) U.S. Cl.

CPC ..... *H01R 13/6581* (2013.01); *H01R 13/6597* (2013.01); *H01R 24/64* (2013.01); *H01R 2107/00* (2013.01)

(58) Field of Classification Search

CPC ..... H01R 13/648; H01R 13/6581; H01R 13/6597; H01R 13/6587; H01R 13/6594; H01R 13/6873; H01R 23/02; H01R 24/60; H01R 24/62

USPC ..... 439/607.34, 607.01, 607.05, 607.4, 660

See application file for complete search history.

(56) References Cited

U.S. PATENT DOCUMENTS

| | | | | |
|---|---|---|---|---|
| 9,379,494 | B1 * | 6/2016 | Hu | H01R 13/6594 |
| 2015/0244111 | A1 * | 8/2015 | Ju | H01R 13/6585 439/607.05 |
| 2016/0197443 | A1 * | 7/2016 | Zhang | H01R 13/6585 439/607.05 |
| 2016/0352050 | A1 * | 12/2016 | Hu | H01R 13/6597 |

* cited by examiner

*Primary Examiner* — Hae Moon Hyeon

(74) *Attorney, Agent, or Firm* — Locke Lord LLP; Tim Tingkang Xia, Esq.

(57) ABSTRACT

An electrical connector includes an insulating body, multiple terminals received in the insulating body, and a metal member fixed to the insulating body. The terminals includes at least one ground terminal. The metal member has a first section and a second section. The second section is higher than the first section. The first section has at least one first elastic piece, the second section has at least one second elastic piece. The first elastic piece and the second elastic piece contact with a same terminal of the at least one ground terminal.

22 Claims, 6 Drawing Sheets

ELECTRICAL CONNECTOR HAVING A GOOD HIGH FREQUENCY TRANSMISSION PERFORMANCE

CROSS-REFERENCE TO RELATED APPLICATION

This non-provisional application claims priority to and benefit of, under 35 U.S.C. §119(a), Patent Application No. 201520712715.X filed in P.R. China on Sep. 16, 2015, the entire content of which is hereby incorporated by reference.

FIELD OF THE INVENTION

The present invention relates generally to an electrical connector, and more particularly to an electrical connector with a good high frequency transmission performance.

BACKGROUND OF THE INVENTION

A Universal Serial Bus (USB) electrical connector in an existing TYPE C standard generally includes an insulating body. Multiple terminals are received in the insulating body. The terminals include differential signal terminals used for transmitting a high frequency signal and ground terminals. The terminals are used for being soldered to a circuit board. A metal member is fixedly arranged on the insulating body and located at the outer side of the terminals. A metal shell sleeves the insulating body. The metal shell is used for being soldered to the circuit board. The metal member urges against the metal shell to be grounded. The metal member is used for shielding noise signals around the terminals. However, since the metal member can be grounded only by the metal shell, and an assembly gap inevitably exists when the metal member and the metal shell are assembled, so that the metal member cannot stably urge against the metal shell, thereby leading to a poor grounding effect of the metal member, a good shielding action cannot be achieved for the terminals, and the electrical connector cannot obtain a good high frequency transmission performance.

Therefore, a heretofore unaddressed need exists in the art to address the aforementioned deficiencies and inadequacies.

SUMMARY OF THE INVENTION

In one aspect, the present invention related to an electrical connector with a good high frequency transmission performance.

In one embodiment, an electrical connector includes an insulating body, multiple terminals received in the insulating body, and a metal member fixed to the insulating body and. The multiple terminals include at least one ground terminal. The metal member has a first section and a second section. The second section is higher than the first section. The first section has at least one first elastic piece, the second section has at least one second elastic piece, and the first elastic piece and the second elastic piece contact with the same ground terminal.

In one embodiment, an extending direction of the first elastic piece is perpendicular to that of the second elastic piece.

In one embodiment, the first elastic piece is provided with a first contact surface urging against the ground terminal, the second elastic piece is provided with a second contact surface urging against the ground terminal, and the first contact surface and the second contact surface are located in a same plane.

In one embodiment, the insulating body includes a base and a tongue extending forward from the base. The first section is horizontally disposed at a rear section of the tongue, the second section is horizontally disposed at the base, a vertical section is disposed between the first section and the second section, and the vertical section is located in a boundary location between the base and the tongue.

In one embodiment, the portion of the tongue close to the base is provided with at least one first avoiding slot, a first guide connecting portion of the ground terminal is exposed at the first avoiding slot, the first elastic piece urges against the first guide connecting portion of the ground terminal via the first avoiding slot, the base is provided with at least one second avoiding slot corresponding to the second elastic piece, a second guide connecting portion of the ground terminal is exposed at the second avoiding slot, and the second elastic piece extends into the second avoiding slot to urge against the second guide connecting portion of the ground terminal.

In one embodiment, the ground terminal has a contacting portion exposed out of the surface of the tongue, a connecting portion extending backward from the contact portion and from the tongue to the base, and a soldering arm bending and extending backward from the connecting portion. Both the first elastic piece and the second elastic piece contact with the connecting portion.

In one embodiment, the metal member includes a first metal member and a second metal member fixed with the first metal member. The first metal member is located at the upper side of the insulating body and is provided with the first section, the second section, as well as the first elastic piece and the second elastic piece extending respectively from the first section and the second section. The second metal member is located at the lower side of the insulating body and has a third section and a fourth elastic piece extending from the third section. There are a plurality of ground terminals. The terminals are located between the first metal member and the second metal member. Both the first elastic piece and the second elastic piece of the first metal member elastically urge against one of the same ground terminals, and the fourth elastic piece of the second metal member elastically urges against another one of the ground terminals.

In one embodiment, one side of the first section is transversely provided with an opening, and the first elastic piece formed by transversely extending from one side of the opening elastically urges against a plate surface of the ground terminal.

In one embodiment, one side of the second section is provided with a horizontally arranged fixing strip, the second elastic piece is formed by tearing from one side of the fixing strip, and the second elastic piece extends downward obliquely to elastically urge against a plate surface of the ground terminal.

In one embodiment, the insulating body includes a base and a tongue extending forward from the base. A shielding casing is arranged outside the insulating body and encircles the tongue to form a plug interface. The second section is provided with at least one third elastic piece urging against the shielding casing, and the third elastic piece is parallel with the fixing strip.

In another aspect, the present inventions related to an electrical connector. In one embodiment, an electrical connector includes an insulating body, multiple terminals received in the insulating body, a shielding sheet disposed in the insulating body, and a metal member fixed to one side of the insulating body. The terminals are divided into upper and lower two rows at the insulating body and include at least one ground terminal. The shielding sheet is located between the upper and lower two rows of the terminals. The metal member has two elastic pieces contacting with the same ground terminal.

In one embodiment, the two elastic pieces include a first elastic piece and a second elastic piece, and an extending direction of the first elastic piece is perpendicular to that of the second elastic piece.

In one embodiment, the first elastic piece has a first contact surface urging against the ground terminal, the second elastic piece has a second contact surface urging against the ground terminal, and the first contact surface and the second contact surface are located in a same plane.

In one embodiment, the metal member includes a first metal member and a second metal member fixed with the first metal member. The upper and lower two rows of the terminals are located between the first metal member and the second metal member. Each row of the terminals has a ground terminal. The first metal member is located at the upper side of the insulating body and has the first elastic piece and the second elastic piece elastically urging against the ground terminals in the upper row of terminals. The second metal member is located at the lower side of the insulating body and has a fourth elastic piece elastically urging against the ground terminals of the lower row of terminals.

In one embodiment, the metal member has a first section and a second section. The second section is higher than the first section. The first section is provided with the first elastic piece, the second section is provided with the second elastic piece, and the first elastic piece and the second elastic piece contact with the same ground terminal.

In one embodiment, the insulating body includes a base and a tongue extending forward from the base. The first section is horizontally arranged at a rear section of the tongue, the second section is horizontally arranged at the base, and a vertical section is disposed between the first section and the second section. The vertical section is located in a boundary location between the base and the tongue.

In one embodiment, the portion of the tongue close to the base is provided with at least one first avoiding slot, a first guide connecting portion of the ground terminal is exposed at the first avoiding slot. The first elastic piece urges against the first guide connecting portion of the ground terminal through the first avoiding slot. The base is provided with at least one second avoiding slot corresponding to the second elastic piece. A second guide connecting portion of the ground terminal is exposed at the second avoiding slot, and the second elastic piece extends into the second avoiding slot to urge against the second guide connecting portion of the ground terminal.

In one embodiment, the ground terminal has a contacting portion exposed out of the surface of the tongue, a connecting portion extending horizontally backwards from the contact portion and from the tongue to the base, and a soldering arm bending and extending from backward of the connecting portion. The first elastic piece and the second elastic piece contact with the connecting portion.

In one embodiment, the two outermost terminals located in the upper row of the terminals are both ground terminals. Two opposite sides of the first section are each provided with an opening. The first elastic piece is formed by transversely extending from one side of each of the openings. Each of the first elastic pieces elastically urge against plate surfaces of the two outermost ground terminals.

In one embodiment, the two outermost terminals located in the upper row of the terminals are both ground terminals. Two sides of the second section are respectively provided with a horizontally extending fixing strip. One side of each fixing strip is torn to form the second elastic piece. The two second elastic pieces both extend downward obliquely to elastically urge against plate surfaces of the two outermost ground terminals. In one embodiment, the electrical connector further includes a shielding casing arranged at the periphery of the insulating body in a framing manner. The second section between the two fixing strips has at least one third elastic piece urging against the shielding casing.

In one embodiment, the shielding casing includes a bottom wall, a top wall and two side walls connected with the bottom wall and the top wall. An elastic arm extends from two sides of the shielding sheet respectively and protrudes out of the insulating body. The two elastic arms correspondingly urge against the side walls.

Compared with related art, certain embodiments of the present invention have following beneficial effects: the metal member is provided with the first elastic piece and the second elastic piece which contact with the same ground terminal, so that a plurality of conductive return paths are formed between the metal member and the ground terminal, therefore, not only a shielding effect of the electrical connector is enhanced, and the metal member can be stably grounded since the metal member is grounded by contacting with the ground terminal, good shielding protection is achieved for signal transmission of the terminals, resonance is reduced, and the electrical connector has a good high frequency transmission performance.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
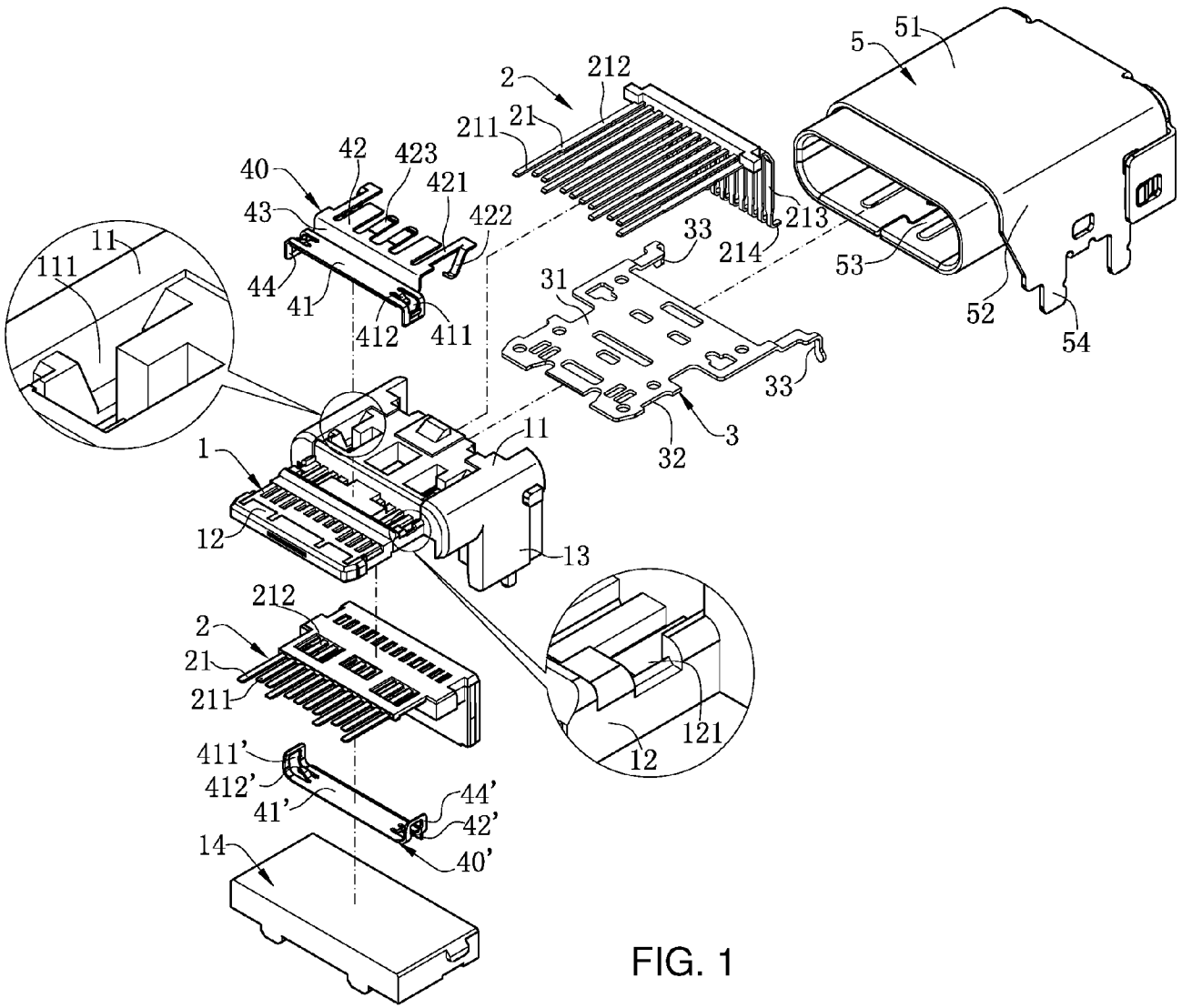
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

As shown in FIGS. 1-4, in certain embodiments of the present invention, an electrical connector 100 is mounted on a circuit board (not shown). The electrical connector 100 includes an insulating body 1, multiple terminals 2 received in the insulating body 1 and divided into upper and lower two rows disposed at the insulating body 1, a shielding sheet 3 disposed in the insulating body 1 and located between the upper and lower rows of the terminals 2, a metal member 4 fixed to the insulating body 1, and a shielding casing 5 framing the outside of the insulating body 1.

Figure 5:
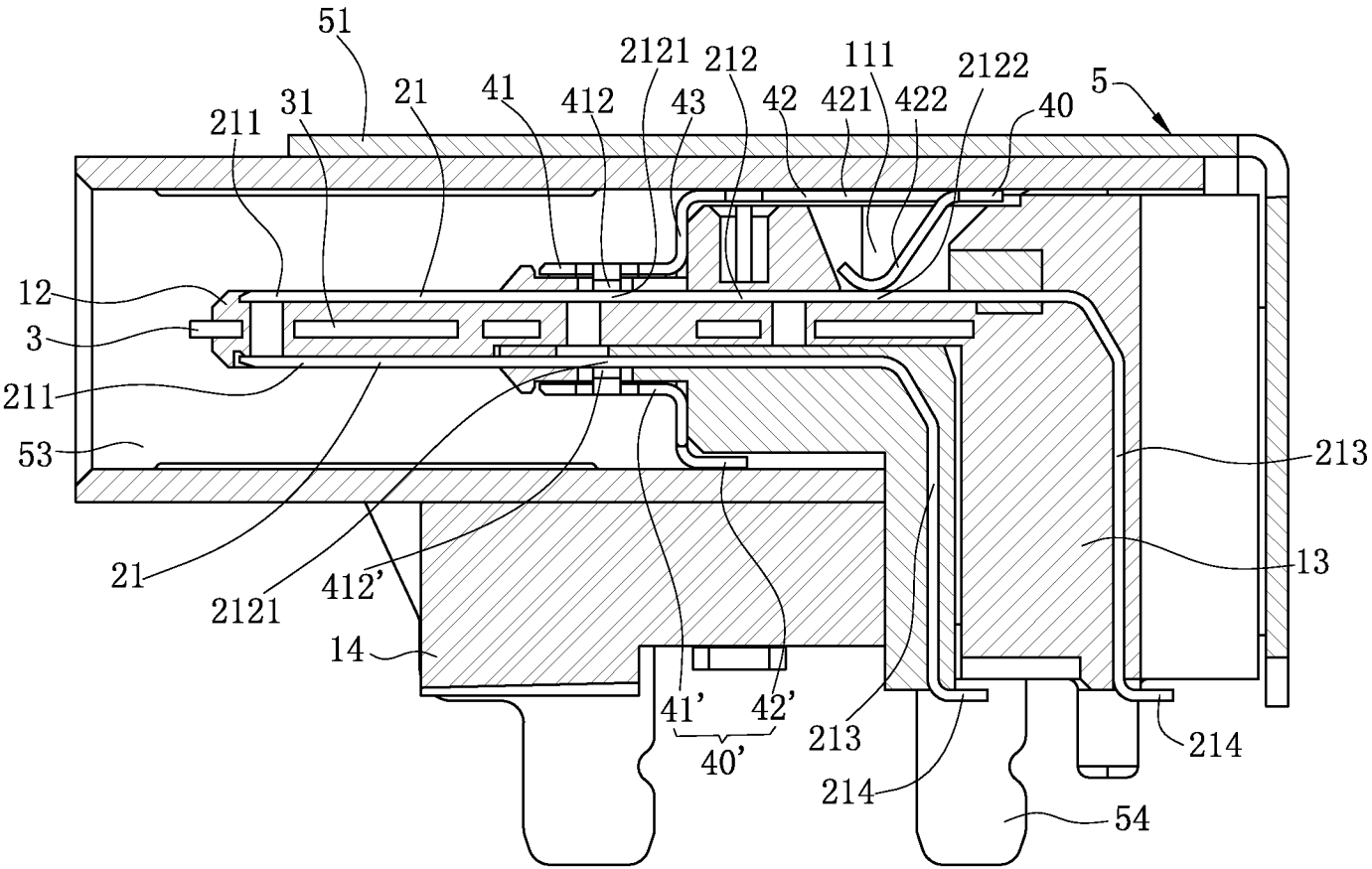
FIG. 5 is a sectional view of FIG. 2 along an A-A direction.

As shown in FIGS. 1 and 5, the insulating body 1 includes a base 11 and a tongue 12 extending forward from the base 11. A heightening portion 13 integrally extends downward from the base 11. At least one first avoiding slot 121 is depressed from the portion of the tongue 12 close to the base 11. In the present embodiment, four first avoiding slots 121 are arranged and are respectively depressed from the two sides of upper and lower surfaces of the tongue 12. The two first avoiding slots 121 located on the upper surface of the tongue 12 correspond respectively to the two first avoiding slots 121 located on the lower surface of the tongue 12. In other embodiments, the tongue 12 can be provided with one or multiple first avoiding slots 121. The base 11 is provided with at least one second avoiding slot 111. In this embodiment, two second avoiding slots 111 are arranged, and are respectively located at two sides of the upper surface of the base 11. Each of the second avoiding slots 111 is depressed downward from the upper surface of the base 11, and each of the second avoiding slots 111 and the corresponding first avoiding slots 121 are correspondingly located in a same straight line in a front and back direction. In this embodiment, the lower surface of the base 11 is not provided with the second avoiding slot 111, and in other embodiments, two sides of the lower surface of the base 11 can also be provided with the second avoiding slots 111.

As shown in FIGS. 1-4, the terminals 2 located on the insulating body 1 are divided into upper and lower two rows. The terminals 2 include at least one ground terminal 21. In certain embodiments, four ground terminals 21 are arranged and respectively located in the upper row and lower row. In other embodiments, one or multiple ground terminals 21 can be arranged as long as the ground terminals 21 contact with the metal member 4. In this embodiment, each row has 12 terminals 2. The 12 terminals 2 located in the upper row and the 12 terminals 2 located in the lower row are opposite in left and right arrangement sequence, symmetric in up and down arrangement manner, and same in transmitting signal. The upper row of terminals 2 are arranged in sequence from left to right and are sequentially a ground terminal (GND) 21, a differential signal high speed transmitting terminal pair (TX1+, TX1−, namely a USB3.0 terminal), a power source terminal (Vbus), a reserved terminal (CC1), a USB 2.0 differential terminal pair (Dp1, Dn1), a reserved terminal (SBU1), a power terminal (Vbus), a differential signal high speed receiving terminal pair (RX2+, RX2−) and a ground terminal (GND) 21. That is, the two outermost terminals in the upper row of the terminals 2 are both the ground terminals 21. The lower row of terminals 2 are arranged in sequence from right to left and are sequentially a ground terminal (GND) 21, a differential signal high speed receiving terminal pair (TX2+, TX2−, namely a USB3.0 terminal), a power source terminal (Vbus), a reserved terminal (CC2), a USB 2.0 differential terminal pair (Dp2, Dn2), a reserved terminal (SBU2), a power terminal (Vbus), a differential signal high speed receiving terminal pair (RX1+, RX1−) and a ground terminal (GND) 21. That is, the two outermost terminals in the lower row of the terminals 2 are both the ground terminals 21. Due to such arrangement of upper and lower two rows of the terminals 2 located on the insulating body 1, the electrical connector 100 can be inserted in dual orientation.

Figure 2:
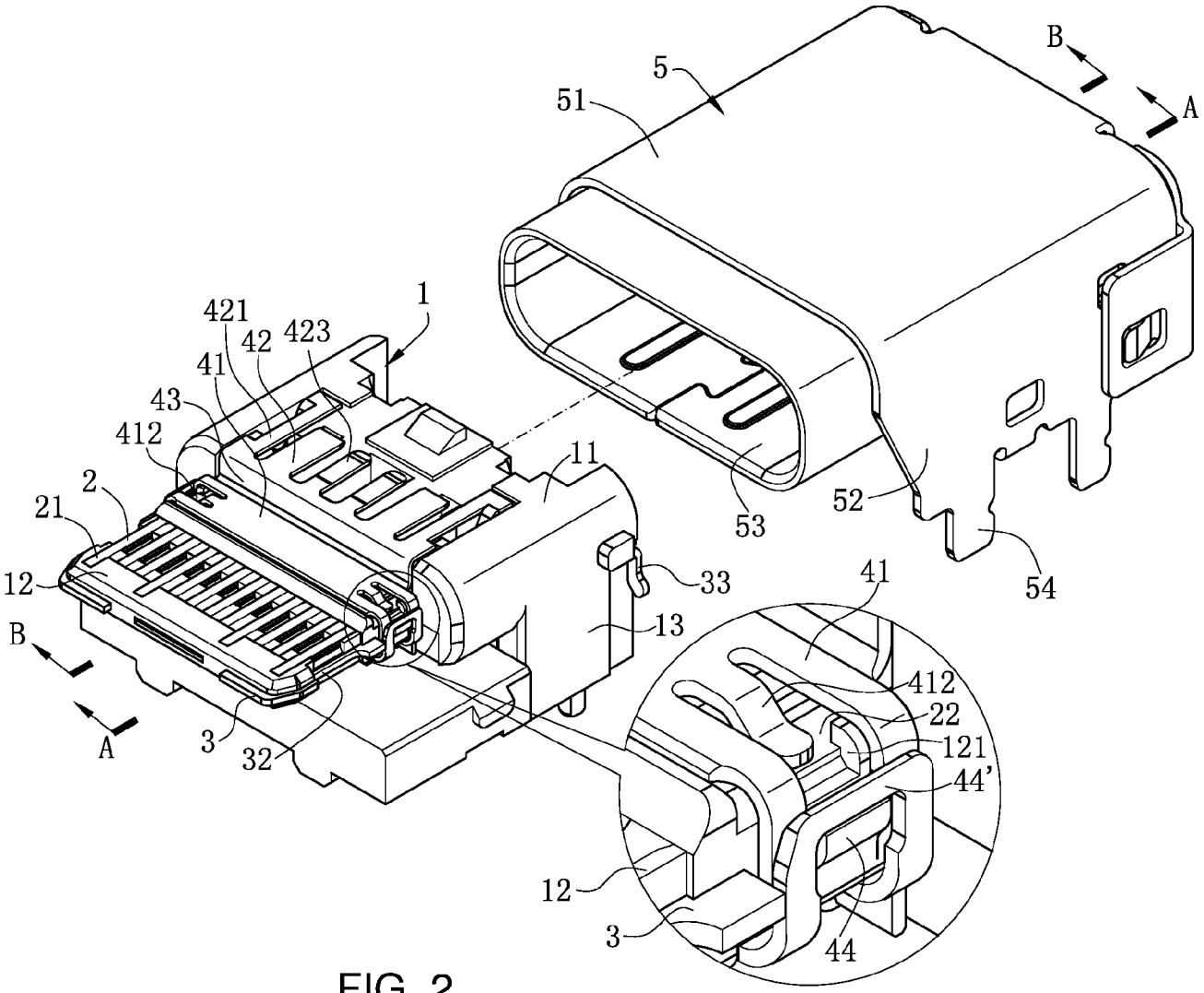
FIG. 2 is a schematic local assembled view of an electrical connector according to one embodiment of the present invention.
Figure 3:
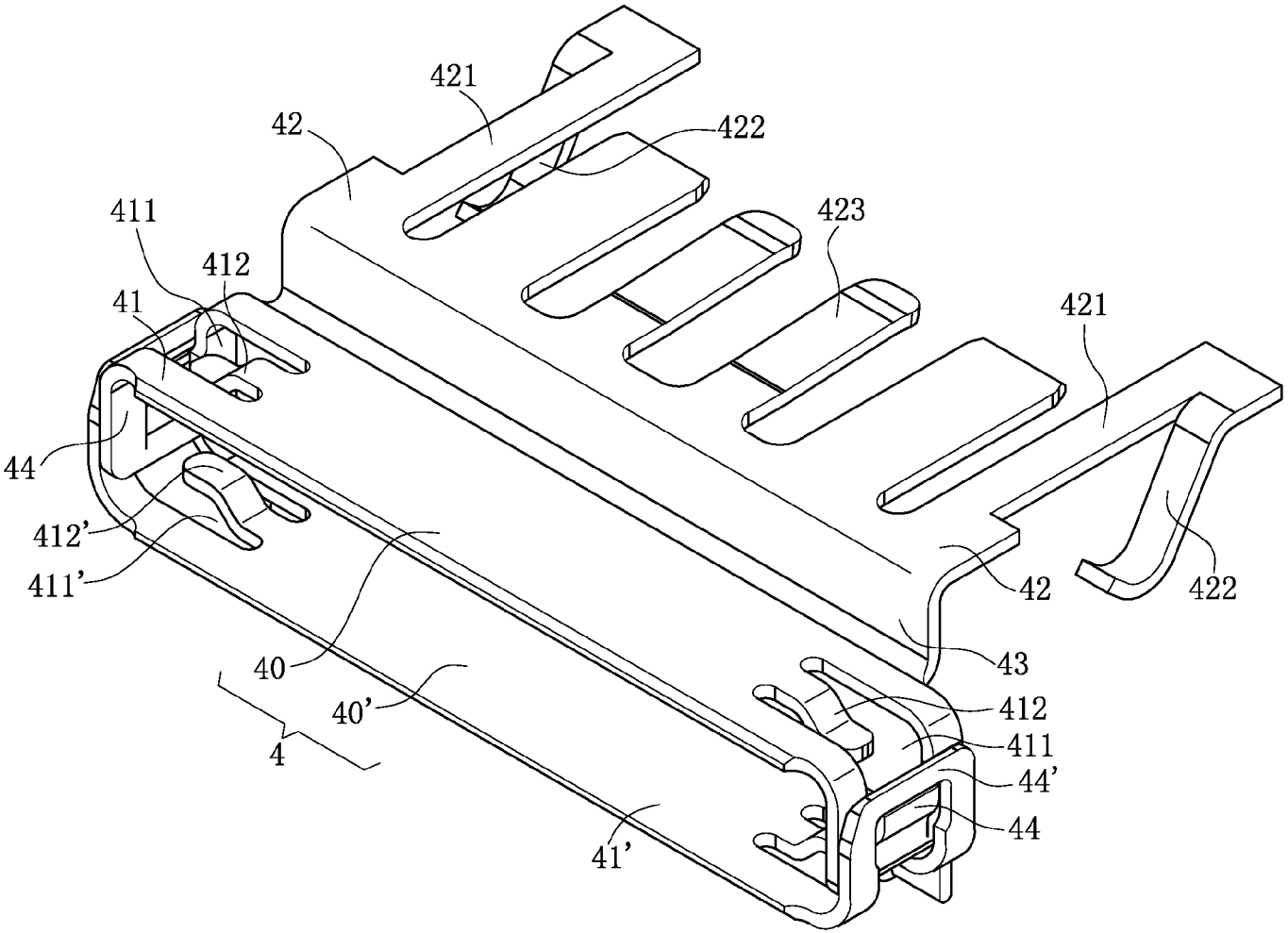
FIG. 3 is a schematic three-dimensional view of a metal member according to one embodiment of the present invention.
Figure 4:
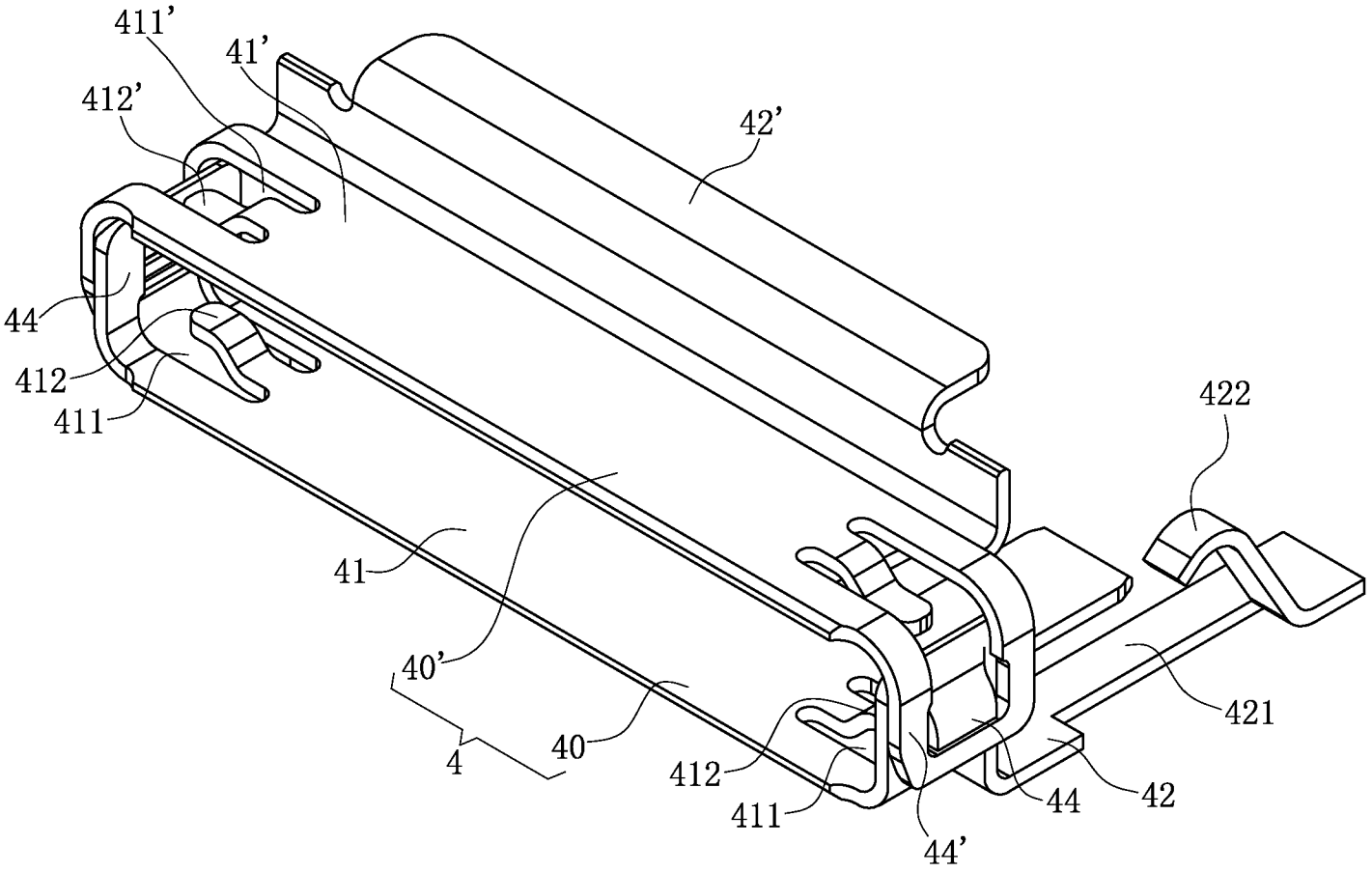
FIG. 4 is a schematic three-dimensional view of FIG. 3 from another angle.
Figure 6:
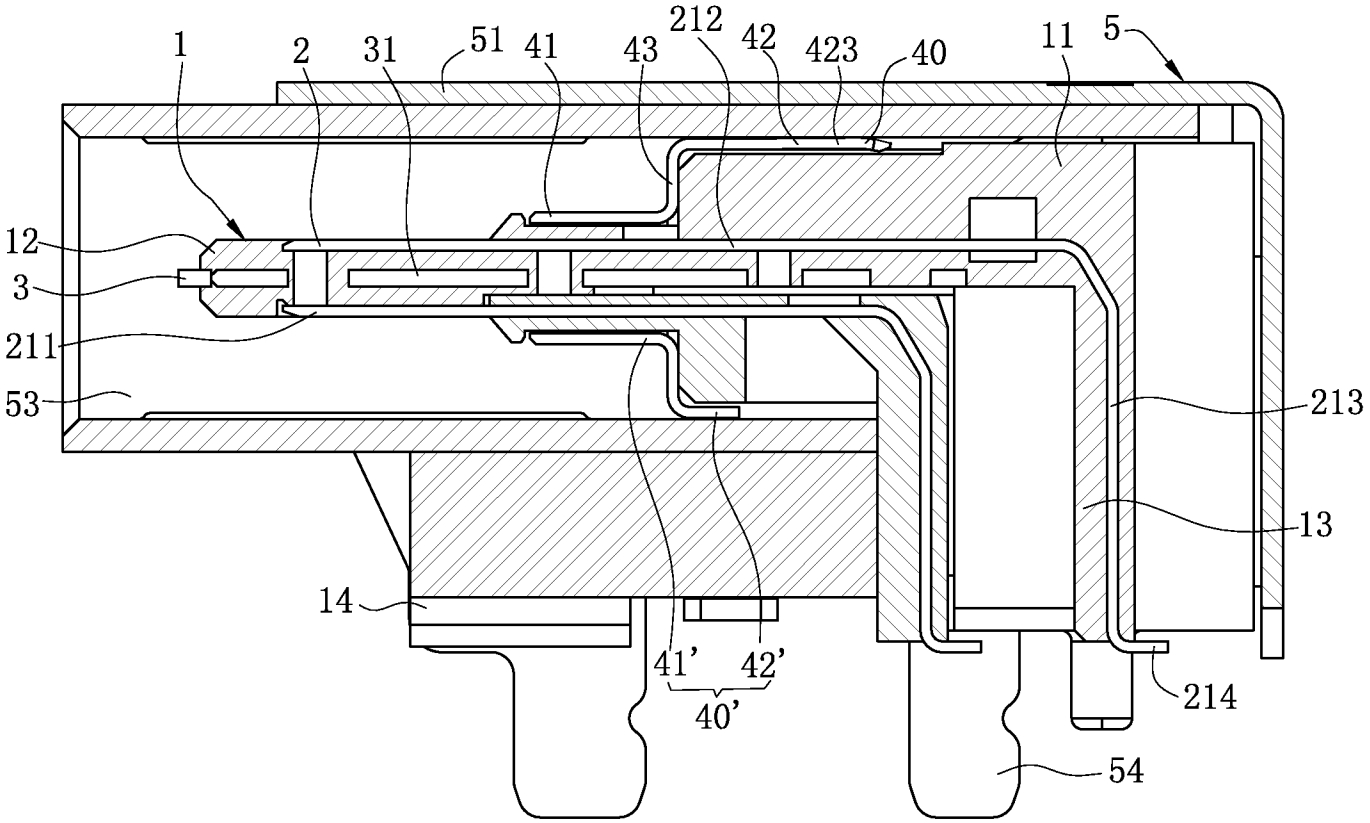
FIG. 6 is a sectional view of FIG. 2 along a B-B direction.

As shown in FIGS. 1, 2 and 6, each terminal 2 is fixed to the insulating body 1. Each terminal 2 has a contact portion 211 at the front portion of the terminal 2. The contact portion 211 is exposed out of the surface of the tongue 12 and is used to be in guide connection with a mating connector (not shown). Each terminal 2 has a connecting portion 212 extending horizontally backward from the contact portion 211. The connecting portion 212 is fixed at the rear end of the tongue 12 and extends to the base 11. Each terminal 2 further includes a soldering arm 213 bending and extending vertically from the backward of the connecting portion 212 to enter the heightening portion 13. A soldering portion 214 extends from the tail end of the soldering arm 213, and extends out of the heightening portion 13, and is used for being soldered to the circuit board. The soldering portion 214 of the ground terminal 21 is soldered to a grounding path on the circuit board.

As shown in FIGS. 1 and 3-5, the front end of each upper row of ground terminals 21 is provided with the contact portion 211 exposed out of the upper surface of the tongue 12. The contact portions 211 are used for being in guide connection with the mating connector. A first guide connecting portion 2121 and a second guide connecting portion 2122 extend horizontally backwards from the contact portion 211 in sequence. The first guide connecting portion 2121 and the second guide connecting portion 2122 are both a part of the connecting portion 212. That is, the connecting portion 212 is provided with the first guide connecting portion 2121 and the second guide connecting portion 2122 in sequence. The first guide connecting portion 2121 and the second guide connecting portion 2122 are both plate surfaces of the ground terminals 21, and the first guide connecting portion 2121 and the second guide connecting portion 2122 are located in a same plane. The first guide connecting portion 2121 is fixed in the tongue 12, the second guide connecting portion 2122 is fixed in the base 11, and the soldering arm 213 of the ground terminal 21 is formed by bending and extending vertically from the backward of the second guide connecting portion 2122. The first guide connecting portion 2121 is exposed out of the first avoiding slot 121 and contacts with the metal member 4, and the second guide connecting portion 2122 is exposed out of the second avoiding slot 111 and contacts with the metal member 4.

As shown in FIGS. 1 and 3-5, each of the ground terminals 21 located in the lower row has an approximately similar structure. Each ground terminal 21 has the contact portion 211 in the front section and exposed out of the lower surface of the tongue 12, the connecting portion 212 extending horizontally backwards from the contact portion 211, and the soldering arm 213 bending and extending vertically from the connecting portion 212. A difference lies in that the ground terminal 21 located in the lower row is provided with the first guide connecting portion 2121 only at the connecting portion 212 and is not provided with the second guide connecting portion 2122, and the first guide connecting portion 2121 is exposed at the first avoiding slot 121 below the tongue 12 to contact with the metal member 4.

As shown in FIG. 1 and FIG. 2, the shielding sheet 3 is formed by punching a metal plate, and includes a plate body 31 disposed at the tongue 12 and located between the contact portions 211 and the connecting portions 212 of the upper and lower two rows of terminals 2. A engagement slot 32 is depressed from each of two side edges of the plate body 31 and is used for clamping with the mating connector. Further, each of two sides of the tail end of the plate body 31 is provided with an elastic arm 33. The two elastic arms 33 extend backward out of the base 11 from two sides of the rear end of the plate body 31, are then bent downward and are located in two opposite sides of the heightening portion 13. The two elastic arms 33 are used for elastically urging against the shielding casing 5 to be grounded, so that interference signals among the upper and lower two rows of terminals 2 are shielded to enhance a shielding effect of the electrical connector 100.

As shown in FIGS. 2-5, the metal member 4 is fixed to the portion of the tongue 12 close to the base 11, and partially extends to the base 11. The metal member 4 is made of a metal material. The metal member 4 is provided with two elastic pieces contacting with the same ground terminal 21. The two elastic pieces are respectively a first elastic piece 412 and a second elastic piece 422. An extending direction of the first elastic piece 412 is vertical to that of the second elastic piece 422. The first elastic piece 412 extends into the first avoiding slot 121 to urge against the first guide connecting portion 2121, and the second elastic piece 422 extends into the second avoiding slot 111 to urge against the second guide connecting portion 2122. That is, the first elastic piece 412 and the second elastic piece 422 both contact with the connecting portion 212 of the same ground terminal 21. The metal member 4 is provided with the first elastic piece 412 and the second elastic piece 422 both contacting with the same ground terminal 21, so that a plurality of conductive return paths are formed between the metal member 4 and the same one ground terminal 21, a shielding effect of the electrical connector 100 is enhanced, and the metal member 4 can be stably grounded since the metal member 4 is grounded by contacting with the ground terminal 21, good shielding protection is achieved for signal transmission of the terminals 2, resonance is reduced, and the electrical connector 100 has a good high frequency transmission performance. Since the extending direction of the first elastic piece 412 is perpendicular to that of the second elastic piece 422, even the metal member 4 is additionally provided with the first elastic piece 412 and the second elastic piece 422, an integral area of the metal member 4 is not required to be additionally added, thus reducing a manufacturing cost under the premise of ensuring full grounding of the metal member 4.

As shown in FIGS. 2-5, the first elastic piece 412 is provided with a first contact surface (not numbered) urging against the first guide connecting portion 2121, the first contact surface is a plate surface of the first elastic piece 412. The second elastic piece 422 is provided with a second contact surface (not numbered) urging against the second guide connecting portion 2122. The second contact surface is a plate surface of the first elastic piece 422, and the first contact surface and the second contact surface are located in the same plane. Since the first guide connecting portion 2121 and the second guide connecting portion 2122 are both plate surfaces of the ground terminal 21, that is, the contact between the first elastic piece 412 and the second elastic piece 422 and the same ground terminal 21 is plate surface contact, a contacting area is increased, and a good grounding effect between the metal member 4 and the ground terminal 21 is ensured.

As shown in FIGS. 1 and 3-5, the metal member 4 has a first section 41, a second section 42 and a vertical section 43 connecting the first section 41 and the second section 42. The first section 41 is horizontally disposed at a rear section of the tongue 12. The second section 42 is horizontally disposed at the base 11. The vertical section 43 is located in a boundary location between the base 11 and the tongue 12. In this embodiment, the second section 42 is higher than the first section 41. In other embodiments, the second section 42 can be higher than the first section 41, and is not limited thereto. Two opposite sides of the first section 41 are each provided with an opening 411. The first elastic piece 412 is formed by transversely extending and downward inclining from one side of each of the openings 411. The two first elastic pieces 412 respectively elastically urge against the first guide connecting portions 2121 of the two outermost ground terminals 21. Since the first elastic piece 412 is formed by extending from one side of the corresponding opening 411, the first elastic piece 412 has enough elasticity to elastically urge against the first guide connecting portions 2121, and the contact between the first elastic piece 412 and the ground terminal 21 is more stable. Two sides of the second section 42 are each provided with a horizontally disposed fixing strip 421. One side of each fixing strip 421 is torn to form the second elastic piece 422. The two second elastic pieces 422 both downward obliquely extend to elastically urge against the second guide connecting portions 2122 of the two outermost ground terminals 21. Since the second section 42 is higher than the first section 41, and the second elastic pieces 422 are formed by tearing from the fixing strips 421 and downwards obliquely extend, a positive force of the second elastic piece 422 is increased. The second elastic piece 422 has enough elasticity to downwards urge against the second guide connecting portion 2122, and stable contact between the second elastic piece 422 and the ground terminal 21 is ensured. The second section 42 between the two fixing strips 421 has at least one third elastic piece 423 urging against the shielding casing 5. The third elastic piece 423 is parallel with the fixing strips 421. The third elastic piece 423 is formed by extending backward from the tail end of the second section 42. The tail end of the third elastic piece 423 perks upward to conveniently urge against the inner wall surface of the shielding casing 5, so that noise and crosstalk received by the metal member 4 can be transmitted to a grounding path of a circuit board by the ground terminal 21 and can also be transmitted to the grounding path of the circuit board by the shielding casing 5, and the metal member 4 has a better shielding effect. In the embodiment, two third elastic pieces 42 exist. In other embodiments, one or three third elastic pieces 423 can be arranged as long as the third elastic pieces 423 stably urge against the shielding casing 5.

As shown in FIGS. 1-4, in this embodiment, the metal member 4 includes a first metal member 40 and a second metal member 40'. The first metal member 40 is located at the upper side of the insulating body 1, the second metal member 40' is located at the lower side of the insulating body 1, and the upper and lower two rows of terminals 2 are located between the first metal member 40 and the second metal member 40'. That is, the first metal member 40 is located at the upper side of the terminals 2, the second metal member 40' is located at the lower side of the terminals 2. The first metal member 40 is provided with a first section 41 and a second section 42, as well as two first elastic pieces 412 and two second elastic pieces 422 extending from the first section 41 and the second section 42 respectively. The two first elastic pieces 412 of the first metal member 40 correspondingly elastically urge against the first guide connecting portions 2121 of the two ground terminals 21 in the upper row, and the two second elastic pieces 422 of the first metal member 40 correspondingly elastically urge against the second guide connecting portions 2122 of the two ground terminals 21 in the upper row. The second metal member 40' is provided with a third section 41' and an extending section 42' extending downward from the third section 41' and then bending and extending horizontally. The third section 41' of the second metal member 40' corresponds to the first section 41 of the first metal member 40. The extending section 42' is lower than the third section 41'. In this embodiment, the extending section 42' is not provided with the second elastic piece 422. In other embodiments, the extending section 42' can be provided with the second elastic piece 422 to contact with the ground terminal 21. Two opposite sides of the third section 41' are each provided with an hole 411', and a fourth elastic piece 412' is formed transversely by extending and upward inclining from one side of each of the holes 411'. The fourth elastic pieces 412' of the second metal member 40' correspond to the first elastic pieces 412 of the first metal member 40, and urge against the first guide connecting portions 2121 of the two ground terminals 21 in the lower row. That is, the first elastic pieces 412 and the second elastic pieces 422 of the first metal member 40 and the fourth elastic pieces 412' of the second metal member 40' respectively urge against the two ground terminals 21 in the upper row and the two ground terminals 21 in the lower row, so that the metal member 4 contacts with the ground terminals 21 to form multiple conducting paths. The metal member 4 is fully and stably grounded and a high frequency performance of the electrical connector 100 is further improved. Two sides of the first section 41 of the first metal member 40 are respectively bent and extend downward to form a buckling portion 44. Two sides of the third section 41' of the second metal member 40' are correspondingly provided with the buckling portions 44' respectively. By buckling and combining the buckling portions 44 and 44', the first metal member 40 and the second metal member 40' are fixed at the portion of the tongue 12 close to the base 11. In this embodiment, the metal member 4 has two portions. In other embodiments, the metal member 4 can be integrally formed and sleeves the tongue 12 from front to back and is not limited thereto.

As shown in FIGS. 2, 5, and 6, the shielding casing 5 includes a top wall 51, a bottom wall (not labeled) and two side walls 52 connected with the bottom wall and the top wall 51. The top wall 51, the bottom wall and the two side walls 52 encircle the tongue 12 to form a plug interface 53, and the heightening portion 13 is lower than the plug interface 53. The top wall 51 is integrally backward bent to form a rear cover (not labeled) which is located behind the heightening portion 13 and partially shields the heightening portion 13 to shield signal interference at the outer side of the soldering arm 213. A bolster block 14 is disposed below the bottom wall. The bolster block 14 is correspondingly assembled at the front end of the heightening portion 13 so as to fill a gap below the plug interface 53, above the circuit board and in front of the heightening portion 13, prevent the electrical connector 100 from tilting forward due to plugging and unplugging for many times, and prolong the service life. Two soldering legs 54 respectively extend downward from two side walls 52. The soldering legs 54 are used for being soldered to the circuit board to ground the shielding casing 5. The two elastic arms 33 of the shielding sheet 3 respectively urge against the inner sides of the two side walls 52, thus grounding the shielding sheet 3.

In conclusion, the electrical connector 100 according to certain embodiments of the present invention has following beneficial advantages.

(1) The metal member 4 has the first elastic piece 412 and the second elastic piece 422, which contact with the same ground terminal 21, so that a plurality of conductive return paths are formed between the metal member 4 and the ground terminal 21, the shielding effect of the electrical connector 100 is enhanced, and the metal member 4 can be stably grounded since the metal member 4 is grounded by contacting with the ground terminal 21, good shielding protection is achieved for signal transmission of the terminals 2, resonance is reduced, and the electrical connector 100 has a good high frequency transmission performance.

(2) Since the first guide connecting portion 2121 and the second guide connecting portion 2122 are both plate surfaces of the ground terminal 21, that is, the contact between the first elastic piece 412 and the second elastic piece 422 and the same ground terminal 21 is plate surface contact, a contact area is increased, and a good grounding effect between the metal member 4 and the ground terminal 21 is ensured.

(3) Since the extending direction of the first elastic piece 412 is perpendicular to that of the second elastic piece 422, even the metal member 4 is additionally provided with the first elastic piece 412 and the second elastic piece 422, an integral area of the metal member 4 is not required to be additionally added, thus reducing a manufacturing cost under the premise of ensuring full grounding of the metal member 4.

(4) Since the first elastic piece 412 is formed by extending from one side of each of the openings 411, the first elastic piece 412 has enough elasticity to elastically urge against the first guide connecting portions 2121, and contact between the first elastic piece 412 and the ground terminal 21 is more stable. In addition, the second section 42 is higher than the first section 41, and the second elastic pieces 422 are formed by tearing from the fixing strips 421 and downwards obliquely extend, a positive force of the second elastic piece 422 is increased, the second elastic piece 422 has sufficient elasticity to downwards urge against the second guide connecting portion 2122, and stable contact between the second elastic piece 422 and the ground terminal 21 is ensured.

(5) The third elastic piece 423 is formed by backward extending from the tail end of the second section 42, the tail end of the third elastic piece 423 is upward perked to conveniently urge against the inner wall surface of the shielding casing 5, so that noise and crosstalk received by the metal member 4 can be transmitted to a grounding path of a circuit board by the ground terminal 21 and can also be transmitted to the grounding path of the circuit board by the shielding casing 5, and the metal member 4 has a better shielding effect.

(6) The first elastic pieces 412 and the second elastic pieces 422 of the first metal member 40 and the fourth elastic pieces 412' of the second metal member 40' respectively urge against the two ground terminals 21 in the upper row and the two ground terminals 21 in the lower row, so that the metal member 4 contacts with the ground terminals 21 to form a plurality of conducting paths, the metal member 4 is fully and stably grounded and a high frequency performance of the electrical connector 100 is further improved.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body;

a plurality of terminals received in the insulating body and including at least one ground terminal; and a metal member fixed to the insulating body and having a first section and a second section, wherein the second section is higher than the first section, the first section is provided with at least one first elastic piece, the second section is provided with at least one second elastic piece, and the first elastic piece and the second elastic piece contact with a same terminal of the at least one ground terminal.

2. The electrical connector of claim 1, wherein an extending direction of the first elastic piece is perpendicular to an extending direction of the second elastic piece.

3. The electrical connector of claim 1, wherein the first elastic piece has a first contact surface urging against the ground terminal, the second elastic piece has a second contact surface urging against the ground terminal, and the first contact surface and the second contact surface are located in a same plane.

4. The electrical connector of claim 1, wherein the insulating body includes a base and a tongue extending forward from the base, the first section is horizontally disposed at a rear section of the tongue, the second section is horizontally disposed at the base, a vertical section is disposed between the first section and the second section, and the vertical section is located in a boundary location between the base and the tongue.

5. The electrical connector of claim 4, wherein a portion of the tongue close to the base is provided with at least one first avoiding slot, a first guide connecting portion of the ground terminal is exposed at the first avoiding slot, the first elastic piece urges against the first guide connecting portion of the ground terminal via the first avoiding slot, the base is provided with at least one second avoiding slot corresponding to the second elastic piece, a second guide connecting portion of the ground terminal is exposed at the second avoiding slot, and the second elastic piece extends into the second avoiding slot to urge against the second guide connecting portion of the ground terminal.

6. The electrical connector of claim 4, wherein the ground terminal comprises a contacting portion exposed out of a surface of the tongue, a connecting portion extending backward from the contact portion and from the tongue to the base, and a soldering arm bending and extending from backward of the connecting portion, and both the first elastic piece and the second elastic piece contact with the connecting portion.

7. The electrical connector of claim 1, wherein the metal member comprises a first metal member and a second metal member fixed with the first metal member;

the first metal member is located at an upper side of the insulating body and comprises the first section, the second section, the first elastic piece extending from the first section, and the second elastic piece extending from the second section;

the second metal member is located at a lower side of the insulating body and comprises a third section and a fourth elastic piece extending from the third section;

the at least one ground terminal comprises a plurality of ground terminals, the ground terminals are located between the first metal member and the second metal member, both the first elastic piece and the second elastic piece elastically urge against one ground terminal of the ground terminals, and the fourth elastic piece elastically urges against another one of the ground terminals.

8. The electrical connector of claim 1, wherein one side of the first section is transversely provided with an opening, and the first elastic piece formed by transversely extending from one side of the opening elastically urges against a plate surface of the ground terminal.

9. The electrical connector of claim 1, wherein one side of the second section is provided with a horizontally disposed fixing strip, the second elastic piece is formed by tearing from one side of the fixing strip, and the second elastic piece extends downwards obliquely to elastically urge against a plate surface of the ground terminal.

10. The electrical connector of claim 9, wherein the insulating body comprises a base and a tongue extending forward from the base, a shielding casing is disposed outside the insulating body and encircles the tongue to form a plug interface, the second section is provided with at least one third elastic piece urging against the shielding casing, and the third elastic piece is parallel with the fixing strip.

11. An electrical connector, comprising:

an insulating body;

a plurality of terminals received in the insulating body, divided into an upper row of terminals and a lower row of terminals at the insulating body, and including at least one ground terminal;

a shielding sheet, disposed in the insulating body and located between the upper row of terminals and the lower row of the terminals; and a metal member fixed to one side of the insulating body and having two elastic pieces contacting with a same ground terminal of the at least one ground terminal.

12. The electrical connector of claim 11, wherein the two elastic pieces include a first elastic piece and a second elastic piece, and an extending direction of the first elastic piece is perpendicular to an extending direction of the second elastic piece.

13. The electrical connector of claim 12, wherein the first elastic piece has a first contact surface urging against the ground terminal, the second elastic piece has a second contact surface urging against the ground terminal, and the first contact surface and the second contact surface are located in a same plane.

14. The electrical connector of claim 12, wherein the metal member comprises a first metal member and a second metal member fixed with the first metal member;

the upper row of terminals and the lower row of terminals are located between the first metal member and the second metal member, each row of the terminals has one ground terminal of the at least one ground terminal;

the first metal member is located at the upper side of the insulating body and has the first elastic piece and the second elastic piece elastically urging against the one ground terminal of the upper row of terminals; and the second metal member is located at the lower side of the insulating body and has a fourth elastic piece elastically urging against the one ground terminal of the lower row of terminals.

15. The electrical connector of claim 12, wherein the metal member comprises a first section and a second section, the second section is higher than the first section, the first section is provided with the first elastic piece, the second section is provided with the second elastic piece, and the first elastic piece and the second elastic piece contact with the same ground terminal.

16. The electrical connector of claim 15, wherein the insulating body includes a base and a tongue extending forward from the base, the first section is horizontally disposed at a rear section of the tongue, the second section is horizontally disposed at the base, a vertical section is disposed between the first section and the second section, and the vertical section is located in a boundary location between the base and the tongue.

17. The electrical connector of claim 16, wherein a portion of the tongue close to the base is provided with at least one first avoiding slot, a first guide connecting portion of the ground terminal is exposed at the first avoiding slot, the first elastic piece urges against the first guide connecting portion of the ground terminal via the first avoiding slot, the base is provided with at least one second avoiding slot corresponding to the second elastic piece, a second guide connecting portion of the ground terminal is exposed at the second avoiding slot, and the second elastic piece extends into the second avoiding slot to urge against the second guide connecting portion of the ground terminal.

18. The electrical connector of claim 16, wherein the ground terminal comprises a contacting portion exposed out of the surface of the tongue, a connecting portion extending backward from the contact portion and from the tongue to the base, and a soldering arm bending and extending from backward of the connecting portion, and both the first elastic piece and the second elastic piece contact with the connecting portion.

19. The electrical connector of claim 15, wherein two outermost terminals of the upper row of the terminals are both ground terminals, two opposite sides of the first section are respectively provided with an opening, the first elastic piece is formed by transversely extending from one side of each of the openings, and each of the first elastic pieces elastically urge against plate surfaces of the two outermost ground terminals.

20. The electrical connector of claim 15, wherein two outermost terminals of the upper row of the terminals are both ground terminals, two opposite sides of the second section are respectively provided with a horizontally extending fixing strip, one side of each fixing strip is torn to form the second elastic piece, and the two second elastic pieces both extend downward obliquely to elastically urge against plate surfaces of the two outermost ground terminals.

21. The electrical connector of claim 20, further comprising a shielding casing disposed at the periphery of the insulating body in a framing manner, and the second section between the two fixing strips is provided with at least one third elastic piece urging against the shielding casing.

22. The electrical connector of claim 21, wherein the shielding casing comprises a bottom wall, a top wall and two side walls connected with the bottom wall and the top wall, an elastic arm extends respectively from each of two sides of the shielding sheet and protrudes out of the insulating body, and the two elastic arms respectively urge against the side walls.

* * * * *